US012185786B2

(12) United States Patent
Wikner et al.

(10) Patent No.: US 12,185,786 B2
(45) Date of Patent: Jan. 7, 2025

(54) HELMET

(71) Applicant: MIPS AB, Täby (SE)

(72) Inventors: Jakob Wikner, Täby (SE); Peter Halldin, Täby (SE)

(73) Assignee: MIPS AB, Täby (SE)

( * ) Notice: Subject to any disclaimer, the term of this patent is extended or adjusted under 35 U.S.C. 154(b) by 0 days.

(21) Appl. No.: 17/793,018

(22) PCT Filed: Feb. 12, 2021

(86) PCT No.: PCT/EP2021/053491
§ 371 (c)(1),
(2) Date: Jul. 14, 2022

(87) PCT Pub. No.: WO2021/160823
PCT Pub. Date: Aug. 19, 2021

(65) Prior Publication Data

US 2023/0037810 A1 Feb. 9, 2023

(30) Foreign Application Priority Data

Feb. 12, 2020 (GB) ..... 2001904
Feb. 12, 2020 (GB) ..... 2001907

(51) Int. Cl.
*A42B 3/14* (2006.01)

(52) U.S. Cl.
CPC ..... *A42B 3/147* (2013.01); *A42B 3/145* (2013.01)

(58) Field of Classification Search
CPC .. A42B 3/14; A42B 3/147; A42B 3/08; A42B 3/085; F16B 5/0657
See application file for complete search history.

(56) References Cited

U.S. PATENT DOCUMENTS 2,758,305 A * 8/1956 Gross ..... A42B 3/14 2/416
3,797,039 A * 3/1974 Penberthy ..... A42B 3/14 2/416

(Continued)

FOREIGN PATENT DOCUMENTS

CN 101227842 A 7/2008
CN 110638131 1/2020

(Continued)

OTHER PUBLICATIONS

Young's Modulus, University of Washington, https://depts.washington.edu/matseed/mse_resources/Webpage/Biomaterials/young%27s_modulus.htm#:~:text=The%20Young%27s%20Modulus%20of%20a,it%20is%20bended%20or%20stretched, retrieved Jan. 24, 2024 (Year: 2024).*

(Continued)

*Primary Examiner* — Heather Mangine
(74) *Attorney, Agent, or Firm* — Husch Blackwell LLP

(57) ABSTRACT

A helmet, comprising:
an outer shell;
a head mount, configured to conform to the head of a wearer; and
a plurality of connectors, each provided between the outer shell and the head mount and each connected to the outer shell and head mount;
wherein the connectors are configured to suspend the head mount within the outer shell such that, in use, an air gap is provided between head mount and the outer shell;
wherein the connectors each have a first connection point connected to the outer shell and a second connection point connected to the head mount; and
at least one connector is configured such that, under tensile loading between the first and the second connection points, the connector extends with a first modu- (Continued)

lus of elasticity up to a threshold extension and extends with a second modulus of elasticity beyond the threshold extension.

18 Claims, 11 Drawing Sheets

(56) References Cited

U.S. PATENT DOCUMENTS 4,035,847 A * 7/1977 Prince ..... A42B 3/14 2/416
4,055,860 A * 11/1977 King ..... A42B 3/14 2/416
4,106,127 A * 8/1978 Marangoni ..... A42B 3/14 2/416
4,304,009 A * 12/1981 Nesbitt ..... A42B 3/14 2/416
4,463,456 A * 8/1984 Hanson ..... A42B 3/14 2/416
4,527,290 A * 7/1985 Zahn ..... A42B 3/147 2/416
5,079,780 A * 1/1992 Coombs ..... A42B 3/08 2/5
5,204,998 A * 4/1993 Liu ..... A42B 3/124 2/425
5,898,949 A * 5/1999 Barthold ..... A42B 3/10 2/5
6,081,931 A * 7/2000 Burns ..... A42B 3/14 2/416
6,449,814 B1 * 9/2002 Dinsmore ..... F16B 5/0664 24/297
7,237,995 B2 * 7/2007 Randez Perez ..... F16B 19/1081 411/48
7,337,505 B1 * 3/2008 Scroggie ..... F16B 5/0657 24/297
8,316,512 B2 * 11/2012 Halldin ..... A42B 3/064 24/90.1
10,808,745 B1 * 10/2020 Javali ..... F16B 21/086
10,893,717 B2 * 1/2021 Pomering ..... A42B 3/064
10,973,273 B2 * 4/2021 Rietdyk ..... F16B 21/09
11,730,223 B2 * 8/2023 Pomering ..... A42B 3/064 2/416
2002/0000004 A1 * 1/2002 Wise ..... A42B 3/14 2/418
2002/0197107 A1 * 12/2002 Granata ..... F16B 5/0628 403/381
2003/0221245 A1 * 12/2003 Lee ..... A42B 3/063 2/412
2009/0038055 A1 * 2/2009 Ferrara ..... A42B 3/14 2/424
2010/0281603 A1 * 11/2010 Ho ..... A42B 3/08 2/421
2013/0061371 A1 3/2013 Phipps et al.
2013/0219596 A1 * 8/2013 Carvell ..... A42B 3/14 2/416
2013/0283507 A1 * 10/2013 Baty ..... A42B 3/14 2/416
2015/0059066 A1 * 3/2015 Ketterer ..... A42B 3/324 2/418
2016/0135535 A1 * 5/2016 Jacobsen ..... A42B 3/08 2/421
2016/0198681 A1 * 7/2016 Fyfe ..... A42B 3/125 361/679.01
2016/0235132 A1 * 8/2016 Sugano ..... A41D 13/0568
2016/0238099 A1 8/2016 Perino et al.
2017/0013907 A1 * 1/2017 Salmini ..... A42B 3/064
2017/0102018 A1 * 4/2017 Kanie ..... F16B 19/008
2017/0105470 A1 * 4/2017 Eaton ..... A42B 3/064
2017/0188647 A1 * 7/2017 Blecherman ..... A42B 1/08
2017/0245578 A1 * 8/2017 Xiong ..... A42B 3/147
2017/0347736 A1 * 12/2017 Penner ..... A42B 3/145
2018/0000186 A1 * 1/2018 Brown ..... A42B 3/064
2018/0271198 A1 * 9/2018 Ku ..... A42B 3/064
2018/0310657 A1 * 11/2018 Axelsson ..... F16B 21/065
2019/0116908 A1 * 4/2019 Halldin ..... A42B 3/14
2019/0166944 A1 * 6/2019 Mini Townson ..... A42B 3/127
2019/0357623 A1 11/2019 Willinger
2020/0037690 A1 * 2/2020 Pomering ..... A42B 3/08
2020/0323299 A1 * 10/2020 Kele ..... A42B 3/127
2021/0085012 A1 * 3/2021 Alvaro ..... A42B 3/063
2023/0037810 A1 * 2/2023 Wikner ..... A42B 3/064

FOREIGN PATENT DOCUMENTS

CN 209931609 U 1/2020
WO WO 2001/045526 6/2001
WO WO 2011/139224 11/2011
WO WO-2018177791 A1 * 10/2018 ..... A42B 3/063
WO WO 2019/119150 6/2019
WO WO 2019/162281 8/2019
WO WO 2019/214960 11/2019

OTHER PUBLICATIONS

Office Action and Search Report for corresponding Chinese Application No. 202180013394.2 dated Nov. 4, 2024 (7 pages).

* cited by examiner

HELMET

RELATED APPLICATIONS

This application is a 35 USC § 371 National Stage application of International Application No. PCT/EP2021/053491, entitled "HELMET," filed on Feb. 12, 2021, which claims the benefit of United Kingdom Patent Application Nos. 2001904.8, filed on Feb. 12, 2020 and 2001907.1, filed on Feb. 12, 2020, the disclosure of which are incorporated herein by reference in their entireties.

The present invention relates to helmets.

Helmets are known for use in various activities. These activities include combat and industrial purposes, such as protective helmets for soldiers and hard-hats or helmets used by builders, mine-workers, or operators of industrial machinery for example. Helmets are also common in sporting activities. For example, protective helmets may be used in ice hockey, cycling, motorcycling, motor-car racing, skiing, snow-boarding, skating, skateboarding, equestrian activities, American football, baseball, rugby, soccer, cricket, lacrosse, climbing, golf, airsoft, roller derby and paintballing.

Helmets can be of fixed size or adjustable, to fit different sizes and shapes of head. In some types of helmet, e.g. commonly in ice-hockey helmets, the adjustability can be provided by moving parts of the helmet to change the outer and inner dimensions of the helmet. This can be achieved by having a helmet with two or more parts which can move with respect to each other. In other cases, e.g. commonly in cycling helmets, the helmet is provided with an attachment device for fixing the helmet to the user's head, and it is the attachment device that can vary in dimension to fit the user's head whilst the main body or shell of the helmet remains the same size. In some cases, comfort padding within the helmet can act as the attachment device. The attachment device can also be provided in the form of a plurality of physically separate parts, for example a plurality of comfort pads which are not interconnected with each other. Such attachment devices for seating the helmet on a user's head may be used together with additional strapping (such as a chin strap) to further secure the helmet in place. Combinations of these adjustment mechanisms are also possible.

Helmets are often made of an outer shell, that is usually hard and made of a plastic or a composite material, and an energy absorbing layer often referred to as a liner. In other arrangements, such as a rugby scrum cap, a helmet may have no hard outer shell, and the helmet as a whole may be flexible. In any case, nowadays, a protective helmet has to be designed so as to satisfy certain legal requirements which relate to inter alia the maximum acceleration that may occur in the centre of gravity of the brain at a specified load. Typically, tests are performed, in which what is known as a dummy skull equipped with a helmet is subjected to a radial blow towards the head. This has resulted in modern helmets having good energy-absorption capacity in the case of blows radially against the skull. Progress has also been made (e.g. WO 2001/045526 and WO 2011/139224, which are both incorporated herein by reference, in their entireties) in developing helmets to lessen the energy transmitted from oblique blows (i.e. which combine both tangential and radial components), by absorbing or dissipating rotation energy and/or redirecting it into translational energy rather than rotational energy.

Such oblique impacts (in the absence of protection) result in both translational acceleration and angular acceleration of the brain. Angular acceleration causes the brain to rotate within the skull creating injuries on bodily elements connecting the brain to the skull and also to the brain itself.

Examples of rotational injuries include Mild Traumatic Brain Injuries (MTBI) such as concussion, and Severe Traumatic Brain Injuries (STBI) such as subdural haematomas (SDH), bleeding as a consequence of blood vessels rapturing, and diffuse axonal injuries (DAI), which can be summarized as nerve fibres being over stretched as a consequence of high shear deformations in the brain tissue.

Depending on the characteristics of the rotational force, such as the duration, amplitude and rate of increase, either concussion, SDH, DAI or a combination of these injuries can be suffered. Generally speaking, SDH occur in the case of accelerations of short duration and great amplitude, while DAI occur in the case of longer and more widespread acceleration loads.

In helmets such as those disclosed in WO 2001/045526 and WO 2011/139224 that may reduce the rotational energy transmitted to the brain caused by oblique impacts, two parts of the helmet may be configured to slide relative to each other at a sliding interface following an oblique impact.

In some helmets a head attachment device is suspended within, and separated from, a hard outer shell. Such helmets may be simple and cheap to manufacture and provide sufficient protection from radial impacts for certain helmet uses. However, it may be desirable to improve the performance of such helmets, for example in the event of an oblique impact, preferably without substantially increasing the manufacturing costs and/or effort.

According to an aspect of the disclosure there is provided a helmet, comprising:

an outer shell;

a head mount, configured to conform to the head of a wearer; and a plurality of connectors, each provided between the outer shell and the head mount and each connected to the outer shell and head mount;

wherein the connectors are configured to suspend the head mount within the outer shell such that, in use, an air gap is provided between head mount and the outer shell;

wherein the connectors each have a first connection point connected to the outer shell and a second connection point connected to the head mount; and at least one connector is configured such that, under tensile loading between the first and the second connection points, the connector extends with a first modulus of elasticity up to a threshold extension and extends with a second modulus of elasticity beyond the threshold extension.

In an arrangement, the second modulus of elasticity is higher than the first modulus of elasticity.

In an arrangement, the second modulus of elasticity is lower than the first modulus of elasticity.

In an arrangement, the at least one connector is configured such that under tensile loading between the first and the second connection points, the connector extends with a third modulus of elasticity beyond a second threshold extension; and the third modulus of elasticity is higher than the second modulus of elasticity.

In an arrangement, at least one modulus of elasticity of the connectors is lower than at least one of the outer shell and the head mount.

According to a further aspect of the disclosure there is provided a helmet, comprising:

an outer shell;

a head mount, configured to conform to the head of a wearer; and a plurality of connectors, each provided between the outer shell and the head mount and each connected to the outer shell and head mount;

wherein the connectors are configured to suspend the head mount within the outer shell such that, in use, an air gap is provided between head mount and the outer shell; and the connectors have a lower modulus of elasticity than at least one of the outer shell and the head mount.

In an arrangement, the connectors are each integrally formed as a single element.

In an arrangement, the connectors are formed from an elastomer.

In an arrangement, the connectors are detachably connected to at least one of the outer shell and the head mount.

In an arrangement, the connectors are connected to at least one of the outer shell and the head mount by a mechanical connection that does not require a separate fixing.

In an arrangement, the connectors are connected to at least one of the outer shell and the head mount by at least one of a snap-fit connection, an interference fit connection and a rotationally engaged connection.

In an arrangement, the head mount is connected to the outer shell by 4 or 6 connectors.

In an arrangement, at least two of the connectors are configured to provide an anchor point for a chin strap.

In an arrangement, the first connection point is configured to prevent rotation relative to the outer shell.

In an arrangement, the second connection point can rotate relative to the outer shell about the first connection point by deformation of the connector.

In an arrangement, the connector comprises at least one limb between the first and second connection points that is not straight when there is no load on the connector; and extension of the connector at one modulus of elasticity corresponds to the at least one limb being deformed to be straight and extension of the connector at a different modulus of elasticity corresponds to the at least one limb being stretched.

In an arrangement, the connector further comprises at least one limb between the first and second connection points that is straight when there is no load on the connector.

In an arrangement, the threshold extension is an increase of at least 10 mm in separation of the first and the second connection points.

In an arrangement, the head mount comprises a plurality of straps that extend across the top of the head of a wearer and extend between an opposing pair of connectors.

In an arrangement, the modulus of elasticity of the straps forming the head mount is higher than the modulus of elasticity of the connectors.

In an arrangement, in the absence of an impact on the helmet, the separation between the outer shell and the head mount at a location corresponding to the top of the head of a wearer provided by the air gap is at least 10 mm, optionally at least 15 mm, optionally at least 20 mm, optionally at least 30 mm, optionally at least 40 mm.

The invention is described in detail below, with reference to the accompanying figures, in which.

Figure 4:
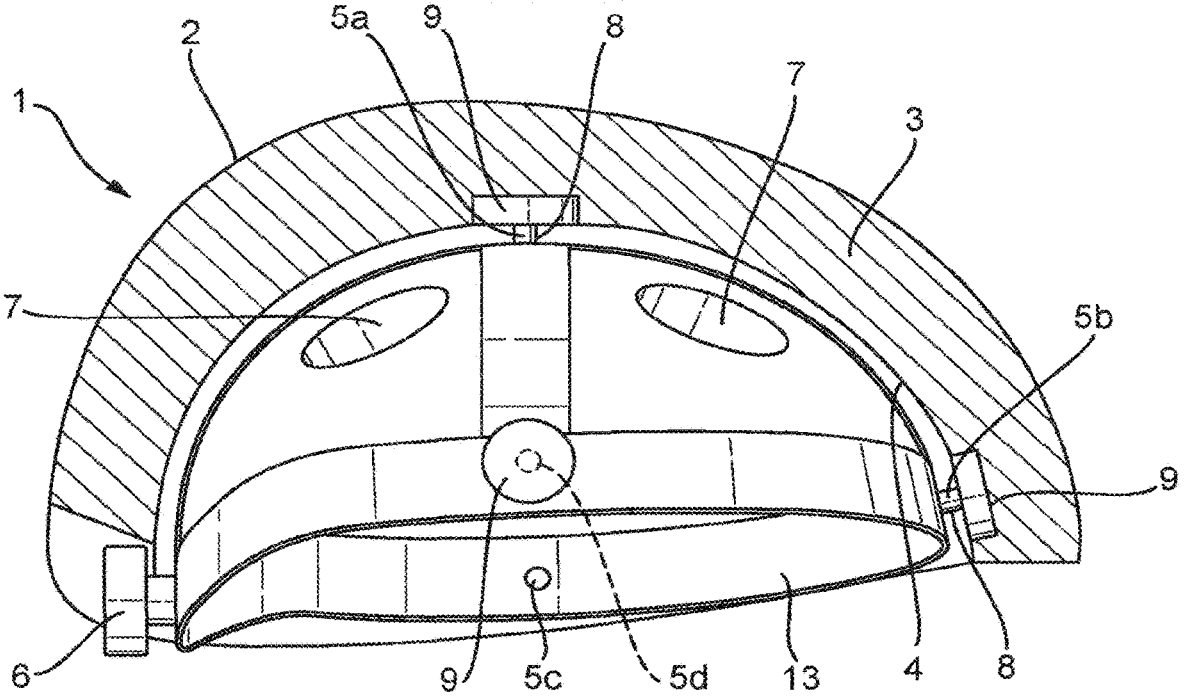
Fig. 4 Prior Art
Figure 5:
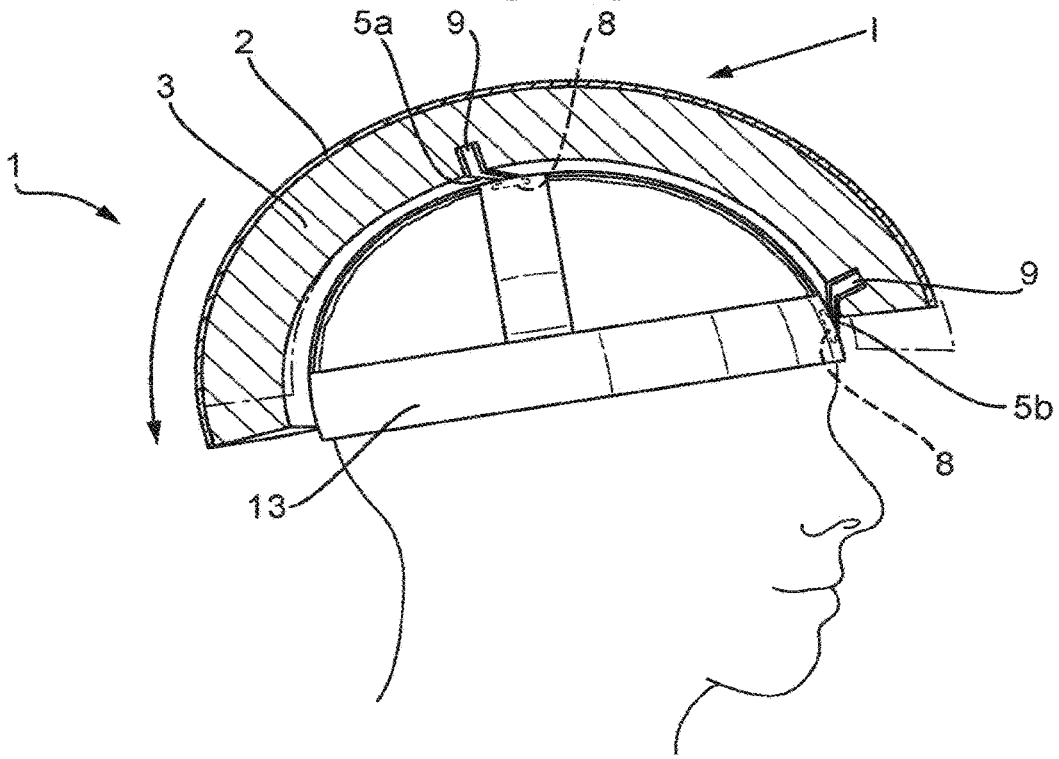
Fig. 5 Prior Art
Figure 6:
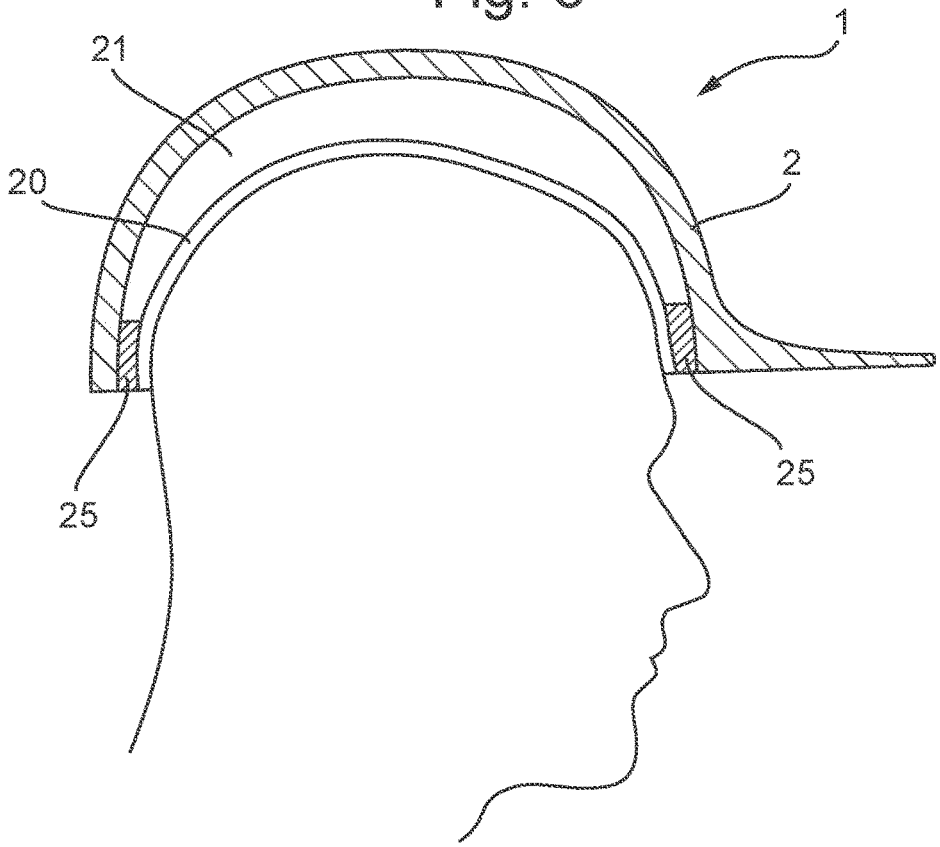
Figure 7:
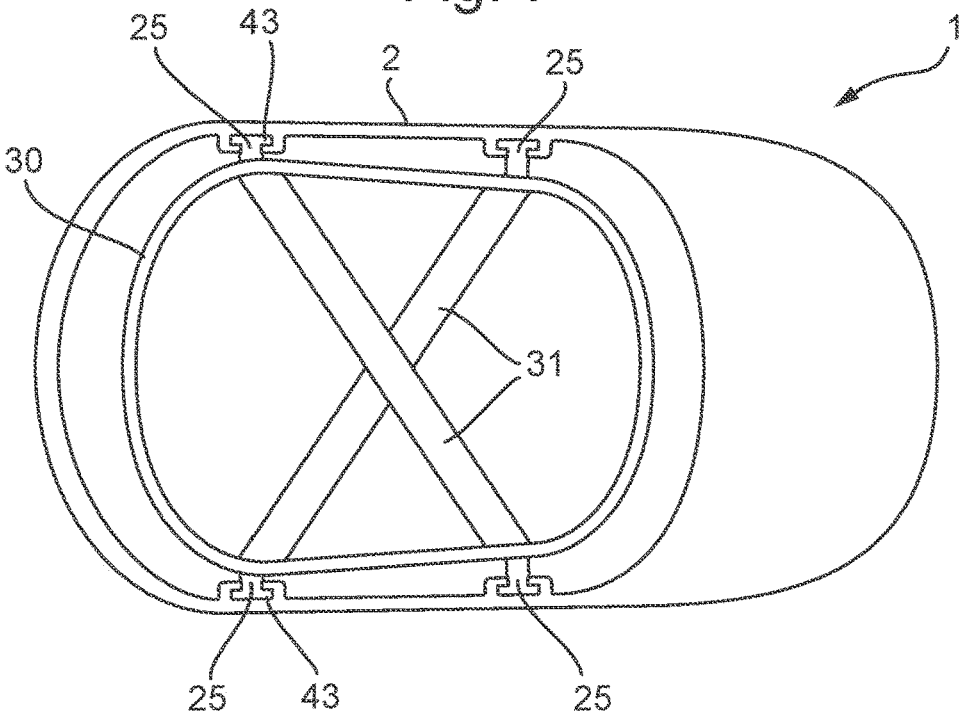
Figure 8:
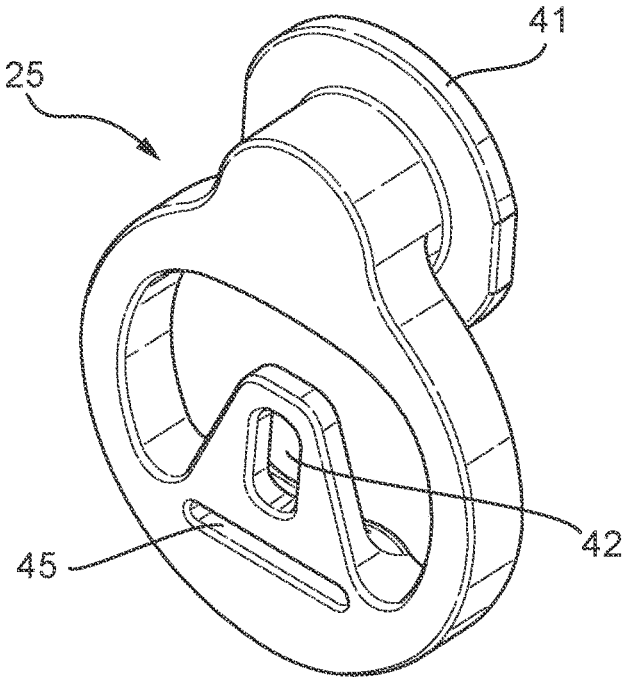
Figure 9:
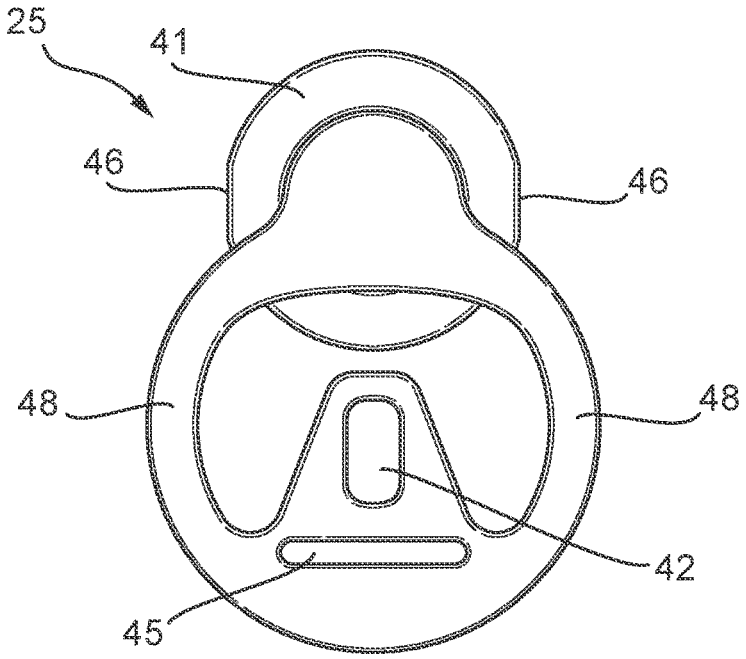
Figure 10:
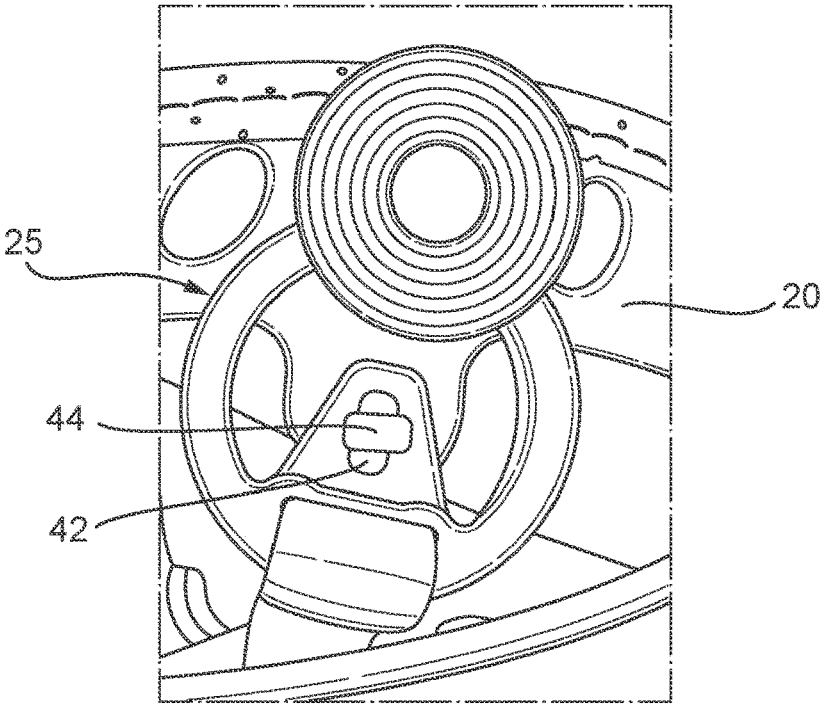
Figure 11:
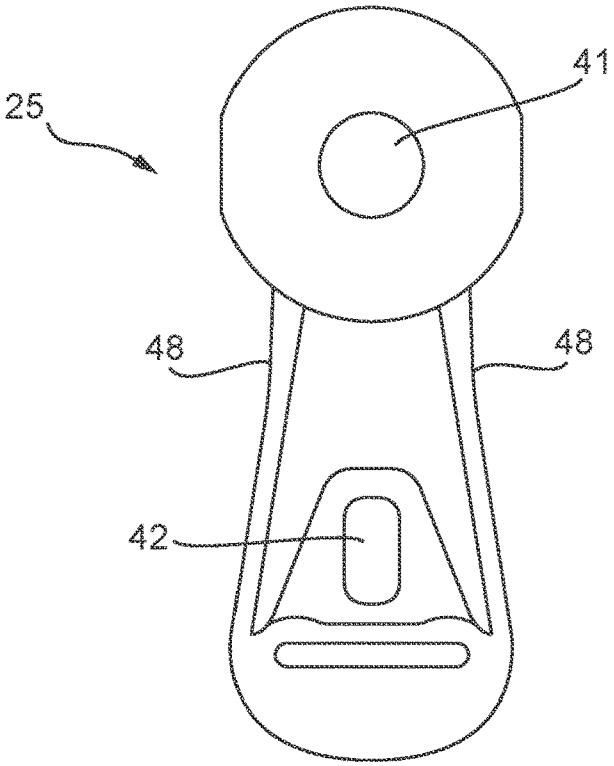

FIGS. 4 and 5 schematically depict another arrangement of a helmet;

FIG. 6 schematically depicts, in a cross-section, another arrangement of a helmet;

FIG. 7 depicts the inside of an example of a helmet according to the arrangement depicted in FIG. 6;

FIGS. 8 and 9 depict a connector for use in a helmet of the arrangement depicted in FIG. 6;

FIG. 10 depicts a connector such as that depicted in FIG. 9 when connected to a head mount;

FIG. 11 depicts a connector such as that depicted in FIG. 9 under tensile loading; and FIGS. 12 to 23 depict alternative arrangements of connectors for use in a helmet.

The proportions of the thicknesses of the various layers in the helmets depicted in the figures have been exaggerated in the drawings for the sake of clarity and can of course be adapted according to need and requirements.

Figure 1:
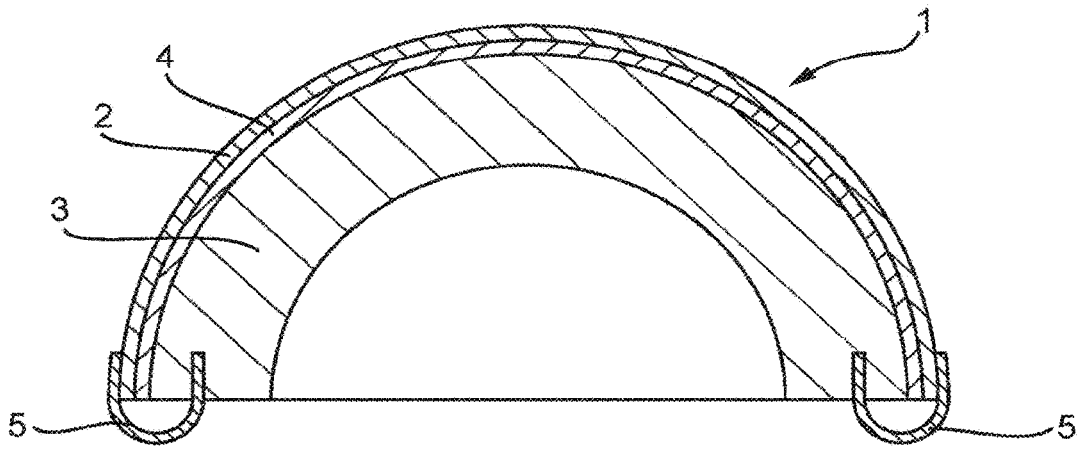
Fig. 1 Prior Art
FIG. 1 depicts a cross-section through a helmet for providing protection against oblique impacts.

FIG. 1 depicts a first helmet 1 of the sort discussed in WO 01/45526, intended for providing protection against oblique impacts. This type of helmet could be any of the types of helmet discussed above.

Protective helmet 1 is constructed with an outer shell 2 and, arranged inside the outer shell 2, an inner shell 3 that is intended for contact with the head of the wearer.

Arranged between the outer shell 2 and the inner shell 3 is a sliding layer 4 (also called a sliding facilitator or low friction layer), which may enable displacement between the outer shell 2 and the inner shell 3. In particular, as discussed below, a sliding layer 4 or sliding facilitator may be configured such that sliding may occur between two parts during an impact. For example, it may be configured to enable sliding under forces associated with an impact on the helmet 1 that is expected to be survivable for the wearer of the helmet 1. In some arrangements, it may be desirable to configure the sliding layer 4 such that the coefficient of friction is between 0.001 and 0.3 and/or below 0.15.

Arranged in the edge portion of the helmet 1, in the FIG. 1 depiction, may be one or more connecting members 5 which interconnect the outer shell 2 and the inner shell 3. In some arrangements, the connectors may counteract mutual displacement between the outer shell 2 and the inner shell 3 by absorbing energy. However, this is not essential. Further, even where this feature is present, the amount of energy absorbed is usually minimal in comparison to the energy absorbed by the inner shell 3 during an impact. In other arrangements, connecting members 5 may not be present at all.

Further, the location of these connecting members 5 can be varied (for example, being positioned away from the edge portion, and connecting the outer shell 2 and the inner shell 3 through the sliding layer 4).

The outer shell 2 is preferably relatively thin and strong so as to withstand impact of various types. The outer shell 2 could be made of a polymer material such as polycarbonate (PC), polyvinylchloride (PVC) or acrylonitrile butadiene styrene (ABS) for example. Advantageously, the polymer material can be fibre-reinforced, using materials such as glass-fibre, Aramid, TWARON™ (para-aramid fibre), carbon-fibre or KEVLAR™ (para-aramid fibre).

The inner shell 3 is considerably thicker and acts as an energy absorbing layer. As such, it is capable of damping or absorbing impacts against the head. It can advantageously be made of foam material like expanded polystyrene (EPS), expanded polypropylene (EPP), expanded polyurethane (EPU), vinyl nitrile foam; or other materials forming a honeycomb-like structure, for example; or strain rate sensitive foams such as marketed under the brand-names PORON™ and D3O™. The construction can be varied in different ways, which emerge below, with, for example, a number of layers of different materials.

Inner shell 3 is designed for absorbing the energy of an impact. Other elements of the helmet 1 will absorb that energy to a limited extent (e.g. the hard outer shell 2 or so-called 'comfort padding' provided within the inner shell 3), but that is not their primary purpose and their contribution to the energy absorption is minimal compared to the energy absorption of the inner shell 3. Indeed, although some other elements such as comfort padding may be made of 'compressible' materials, and as such considered as 'energy absorbing' in other contexts, it is well recognised in the field of helmets that compressible materials are not necessarily 'energy absorbing' in the sense of absorbing a meaningful amount of energy during an impact, for the purposes of reducing the harm to the wearer of the helmet.

A number of different materials and embodiments can be used as the sliding layer 4 or sliding facilitator, for example oil, polytetrafluoroethylene (PTFE; TEFLON™) microspheres, air, rubber, polycarbonate (PC), a fabric material such as felt, etc. Such a layer may have a thickness of roughly 0.1-5 mm, but other thicknesses can also be used, depending on the material selected and the performance desired. The number of sliding layers and their positioning can also be varied, and an example of this is discussed below (with reference to FIG. 3*b*).

As connecting members 5, use can be made of, for example, deformable strips of plastic or metal which are anchored in the outer shell and the inner shell in a suitable manner.

Figure 2:
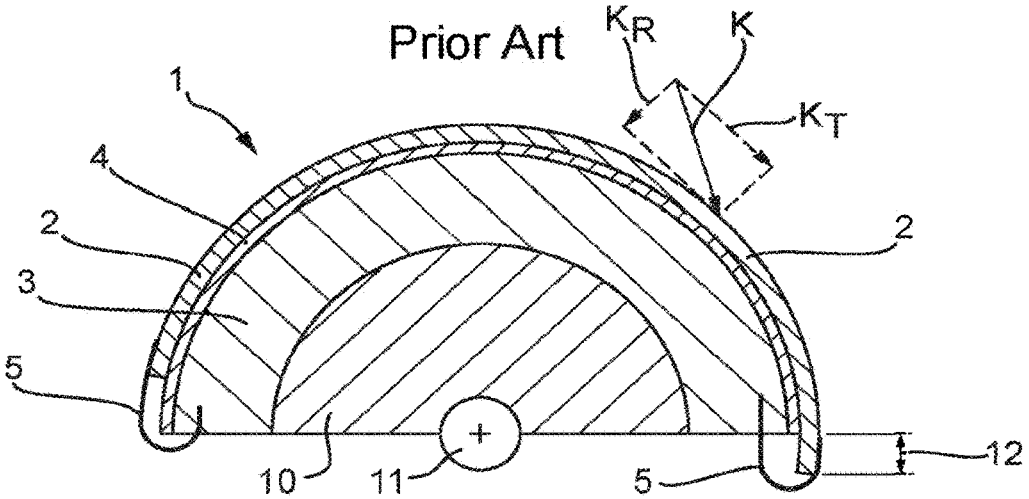
Fig. 2 Prior Art
FIG. 2 is a diagram showing the functioning principle of the helmet of FIG. 1.

FIG. 2 shows the functioning principle of protective helmet 1, in which the helmet 1 and a skull 10 of a wearer are assumed to be semi-cylindrical, with the skull 10 being mounted on a longitudinal axis 11. Torsional force and torque are transmitted to the skull 10 when the helmet 1 is subjected to an oblique impact K. The impact force K gives rise to both a tangential force $K_T$ and a radial force $K_R$ against the protective helmet 1. In this particular context, only the helmet-rotating tangential force $K_T$ and its effect are of interest.

As can be seen, the force K gives rise to a displacement 12 of the outer shell 2 relative to the inner shell 3, the connecting members 5 being deformed. Significant reductions in the torsional force transmitted to the skull 10 can be obtained with such an arrangement. A typical reduction may be roughly 25% but reductions as high as 90% may be possible in some instances. This is a result of the sliding motion between the inner shell 3 and the outer shell 2 reducing the amount of energy which is transferred into radial acceleration.

Sliding motion can also occur in the circumferential direction of the protective helmet 1, although this is not depicted. This can be as a consequence of circumferential angular rotation between the outer shell 2 and the inner shell 3 (i.e. during an impact the outer shell 2 can be rotated by a circumferential angle relative to the inner shell 3).

Figure 3A:
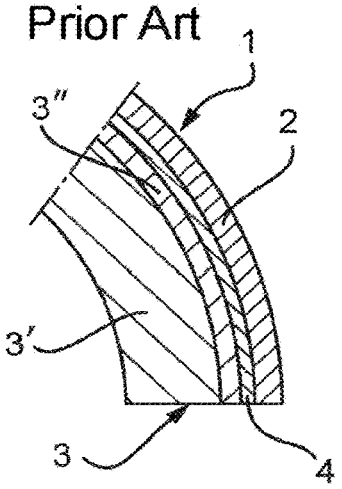
Fig. 3A Prior Art
FIGS. 3A, 3B & 3C show variations of the structure of the helmet of FIG. 1.
Figure 3B:
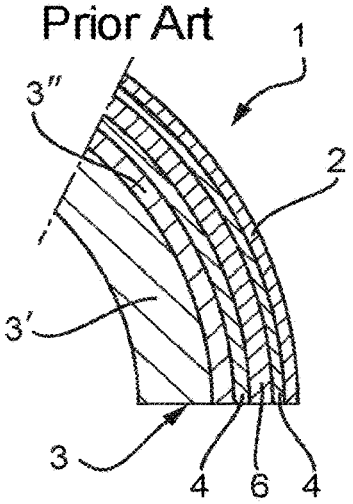
Fig. 3B Prior Art
Figure 3C:
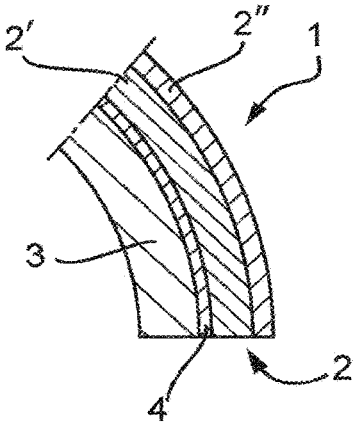
Fig. 3C Prior Art

Other arrangements of the protective helmet 1 are also possible. A few possible variants are shown in FIG. 3. In FIG. 3*a*, the inner shell 3 is constructed from a relatively thin outer layer 3" and a relatively thick inner layer 3'. The outer layer 3" is preferably harder than the inner layer 3', to help facilitate the sliding with respect to outer shell 2. In FIG. 3*b*, the inner shell 3 is constructed in the same manner as in FIG. 3*a*. In this case, however, there are two sliding layers 4, between which there is an intermediate shell 6. The two sliding layers 4 can, if so desired, be embodied differently and made of different materials. One possibility, for example, is to have lower friction in the outer sliding layer than in the inner. In FIG. 3*c*, the outer shell 2 is embodied differently from previously. In this case, a harder outer layer 2" covers a softer inner layer 2'. The inner layer 2' may, for example, be the same material as the inner shell 3.

FIG. 4 depicts a second helmet 1 of the sort discussed in WO 2011/139224, which is also intended for providing protection against oblique impacts. This type of helmet could also be any of the types of helmet discussed above.

In FIG. 4, helmet 1 comprises an energy absorbing layer 3, similar to the inner shell 3 of the helmet of FIG. 1. The outer surface of the energy absorbing layer 3 may be provided from the same material as the energy absorbing layer 3 (i.e. there may be no additional outer shell), or the outer surface could be a rigid shell 2 (see FIG. 5) equivalent to the outer shell 2 of the helmet shown in FIG. 1. In that case, the rigid shell 2 may be made from a different material than the energy absorbing layer 3. The helmet 1 of FIG. 4 has a plurality of vents 7, which are optional, extending through both the energy absorbing layer 3 and the outer shell 2, thereby allowing airflow through the helmet 1.

An interface layer 13 (also called an attachment device) is provided, to interface with (and/or attach helmet 1 to) a wearer's head. As previously discussed, this may be desirable when energy absorbing layer 3 and rigid shell 2 cannot be adjusted in size, as it allows for the different size heads to be accommodated by adjusting the size of the attachment device 13. The attachment device 13 could be made of an elastic or semi-elastic polymer material, such as PC, ABS, PVC or PTFE, or a natural fibre material such as cotton cloth. For example, a cap of textile or a net could form the attachment device 13.

Although the attachment device 13 is shown as comprising a headband portion with further strap portions extending from the front, back, left and right sides, the particular configuration of the attachment device 13 can vary according to the configuration of the helmet. In some cases the attachment device may be more like a continuous (shaped) sheet, perhaps with holes or gaps, e.g. corresponding to the positions of vents 7, to allow air-flow through the helmet.

FIG. 4 also depicts an optional adjustment device 6 for adjusting the diameter of the head band of the attachment device 13 for the particular wearer. In other arrangements, the head band could be an elastic head band in which case the adjustment device 6 could be excluded.

A sliding facilitator 4 is provided radially inwards of the energy absorbing layer 3. The sliding facilitator 4 is adapted to slide against the energy absorbing layer or against the attachment device 13 that is provided for attaching the helmet to a wearer's head.

The sliding facilitator 4 is provided to assist sliding of the energy absorbing layer 3 in relation to an attachment device 13, in the same manner as discussed above. The sliding facilitator 4 may be a material having a low coefficient of friction, or may be coated with such a material.

As such, in the FIG. 4 helmet, the sliding facilitator 8 may be provided on or integrated with the innermost side of the energy absorbing layer 3, facing the attachment device 13.

However, it is equally conceivable that the sliding facilitator 4 may be provided on or integrated with the outer surface of the attachment device 13, for the same purpose of providing slidability between the energy absorbing layer 3 and the attachment device 13. That is, in particular arrangements, the attachment device 13 itself can be adapted to act as a sliding facilitator 4 and may comprise a low friction material.

In other words, the sliding facilitator 4 is provided radially inwards of the energy absorbing layer 3. The sliding facilitator can also be provided radially outwards of the attachment device 13.

When the attachment device 13 is formed as a cap or net (as discussed above), sliding facilitators 4 may be provided as patches of low friction material.

The low friction material may be a waxy polymer, such as PTFE, ABS, PVC, PC, Nylon, PFA, EEP, PE and UHMWPE, or a powder material which could be infused with a lubricant. The low friction material could be a fabric material. As discussed, this low friction material could be applied to either one, or both of the sliding facilitator and the energy absorbing layer.

The attachment device 13 can be fixed to the energy absorbing layer 3 and/or the outer shell 2 by means of fixing members 5, such as the four fixing members 5*a*, 5*b*, 5*c* and 5*d* in FIG. 4. These may be adapted to absorb energy by deforming in an elastic, semi-elastic or plastic way. However, this is not essential. Further, even where this feature is present, the amount of energy absorbed is usually minimal in comparison to the energy absorbed by the energy absorbing layer 3 during an impact.

According to the arrangement shown in FIG. 4 the four fixing members 5*a*, 5*b*, 5*c* and 5*d* are suspension members 5*a*, 5*b*, 5*c*, 5*d*, having first and second portions 8, 9, wherein the first portions 8 of the suspension members 5*a*, 5*b*, 5*c*, 5*d* are adapted to be fixed to the attachment device 13, and the second portions 9 of the suspension members 5*a*, 5*b*, 5*c*, 5*d* are adapted to be fixed to the energy absorbing layer 3.

FIG. 5 shows an arrangement of a helmet similar to the helmet in FIG. 4, when placed on a wearer's head. The helmet 1 of FIG. 5 comprises a hard outer shell 2 made from a different material than the energy absorbing layer 3. In contrast to FIG. 4, in FIG. 5 the attachment device 13 is fixed to the energy absorbing layer 3 by means of two fixing members 5*a*, 5*b*, which are adapted to absorb energy and forces elastically, semi-elastically or plastically.

A frontal oblique impact I creating a rotational force to the helmet is shown in FIG. 5. The oblique impact I causes the energy absorbing layer 3 to slide in relation to the attachment device 13. The attachment device 13 is fixed to the energy absorbing layer 3 by means of the fixing members 5*a*, 5*b*. Although only two such fixing members are shown, for the sake of clarity, in practice many such fixing members may be present. The fixing members 5 can absorb the rotational forces by deforming elastically or semi-elastically. In other arrangements, the deformation may be plastic, even resulting in the severing of one or more of the fixing members 5. In the case of plastic deformation, at least the fixing members 5 will need to be replaced after an impact. In some case a combination of plastic and elastic deformation in the fixing members 5 may occur, i.e. some fixing members 5 rupture, absorbing energy plastically, whilst other fixing members deform and absorb forces elastically.

In general, in the helmets of FIG. 4 and FIG. 5, during an impact the energy absorbing layer 3 acts as an impact absorber by compressing, in the same way as the inner shell of the FIG. 1 helmet. If an outer shell 2 is used, it will help spread out the impact energy over the energy absorbing layer 3. The sliding facilitator 4 will also allow sliding between the attachment device and the energy absorbing layer. This allows for a controlled way to dissipate energy that would otherwise be transmitted as rotational energy to the brain. The energy can be dissipated by friction heat, energy absorbing layer deformation or deformation or displacement of the fixing members. The reduced energy transmission results in reduced rotational acceleration affecting the brain, thus reducing the rotation of the brain within the skull. The risk of rotational injuries including MTBI and STBI such as subdural haematomas, SDH, blood vessel rapturing, concussions and DAI is thereby reduced.

FIG. 6 schematically depicts a cross-section a helmet of a different type from that depicted in FIGS. 1 to 5. In a helmet 1 such as that depicted in FIG. 6, a head mount 20 is suspended within an outer shell 2 such that an air gap 21 is provided between the outer shell 2 and the head mount 20. Helmets of this type are commonly used for industrial purposes, such as by builders, mine-workers or operators of industrial machinery. However, helmets based on such an arrangement may be used for other purposes. In some uses, the outer shell 2 may be a hard shell made of a polymer material such as polycarbonate (PC), polyvinylchloride (PVC), high density polyethylene (HDPE) or acrylonitrile butadiene styrene (ABS) for example. Advantageously, the polymer material can be fibre-reinforced, using materials such as glass-fibre, Aramid, TWARON® (para-aramid fibre), carbon-fibre or KEVLAR™ (para-aramid fibre).

Although the following disclosure relates to an example of a helmet 1 in which the outer shell 2 is formed solely from a hard shell, it should be appreciated that the disclosed arrangement may be applicable to other helmet configurations. For example, the outer shell may alternatively or additionally include a layer of energy absorbing material. Such an energy absorbing material may be made, for example, of a foam material like expanded polystyrene (EPS), expanded polypropylene (EPP), expanded polyurethane (EPU), vinyl nitrile foam; or other materials forming a honeycomb-like structure, or strain rate sensitive foams such as marketed under the brand-names PORON™ and D3O™.

Where used, the layer of energy absorbing material may be provided as a shell over substantially all of the surface of the hard shell facing the wearer's head, although ventilation holes may be provided. Alternatively or additionally, localised regions of energy absorbing material may be provided between the hard shell and the head mount. For example, a band of energy absorbing material may be provided around the lower edge of the hard shell and/or a section of energy absorbing material may be provided to be located above the top of the wearer's head.

In a helmet such as that depicted in FIG. 6, the provision of an air gap 21 between the inner surface of the outer shell 2 and the head mount 20 is intended to ensure that loading caused by an impact on the outer shell 2 is spread across a wearer's head. In particular, the load is not localised on a point on the wearer's head adjacent the point of impact on the helmet 1. Instead, the load is spread across the outer shell 2 and, subsequently, spread across the head mount 20 and therefore spread across the wearer's skull.

During such an impact, the energy of the impact may be absorbed by deformation of parts of the helmet, such as the head mount, reducing the size of the air gap. Accordingly, the size of the air gap 21 between the outer shell 2 and the head mount 20 may be chosen to ensure that, under an impact on the helmet that the helmet is designed to withstand, the head mount 20 does not come into contact with the outer shell 2, namely the air gap 21 is not entirely eliminated such that the impact may be directly transferred from the hard shell to the head mount.

In an arrangement, the helmet 1 may be configured such that, in the absence of an impact on the helmet, the separation between the outer shell 2 and the head mount 20 at a location corresponding to the top of the head of a wearer is at least 10 mm, optionally at least 15 mm, optionally at least 20 mm, optionally at least 30 mm, optionally at least 40 mm. The magnitude of the impact that the helmet 1 is designed to withstand, and therefore the size of the air gap 21, may depend upon the intended use of the helmet 1. It should be understood that, depending on the intended use of the helmet, the size of the air gap 21 may be different at different locations. For example, the air gap 21 may be smaller at the front, back or side of the helmet than it is at the location corresponding to the top of the head of the wearer.

In helmet arrangements that include energy absorbing material, the energy absorbing material may contribute to the helmet's ability to withstand radial impacts. In particular in arrangements in which the energy absorbing material is located within the air gap between the outer shell 2 and the head mount 20 at the location corresponding to the top of the wearer's head, it will be appreciated that the gap between the head mount and the surface of the energy absorbing layer will be smaller than the gap between the outer shell and the head mount, and may be eliminated altogether. Additionally, as a result of the energy absorbing material's contribution in the event of a radial impact, a smaller gap between the outer shell and the head mount may be required than would be the case in the absence of the energy absorbing material.

The head mount 20 may be provided in any form that may conform to the head of a wearer, or at least the top of their head, and mount the helmet to the wearer's head or function to contribute to mounting the helmet to the wearer's head. In some configurations, it may assist in securing the helmet 1 to the wearer's head but this is not essential. In some arrangements, the head mount 20 may include a head band, or head ring, that at least partially surrounds the wearer's head. Alternatively or additionally, the head mount 20 may include one or more straps that extend across the top of the wearer's head. Alternatively or additionally, the head mount 20 may include a cap or shell that encapsulates an upper portion of the wearer's head. Straps or bands that form part of the head mount may be formed from Nylon. Other materials may alternatively or additionally be used.

As shown in FIG. 6, the head mount 20 includes a plurality of connectors 25 that are provided between the outer shell 2 and the head mount 20 and are configured to suspend the head mount 20 within the outer shell 2 in order to provide the air gap 21 between the outer shell 2 and the head mount 20. It should be appreciated that, where the head mount 20 is formed from a plurality of sections, such as a head band, straps that extend across the top of the wearer's head and/or a cap or shell, it may be sufficient for one of those components to be attached to the outer shell by the connectors. Alternatively, different elements of the head mount 20 may have respective connectors. In that case, the connectors 25 for different parts of the head mount 20 may be the same or may be different from each other.

In an arrangement, the connectors 25 may be configured to be relatively elastic, namely to have a lower modulus of elasticity than the outer shell 2 and/or the head mount 20. For the avoidance of doubt, references to the modulus of elasticity of a component refers to the ratio of the force exerted on the component to the extension induced by the force within a given range of extension. It should be appreciated that, for a component formed from multiple elements, this may differ from the modulus of elasticity for the bulk material from which it is formed.

By connecting the head mount 20 to the outer shell 2 using relatively elastic connectors 25, the outer shell 2 may rotate relative to the head mount 20 in response to an impact, providing corresponding benefits in respect of managing impact energies that were discussed above in relation to the arrangements depicted in FIGS. 1 to 5. Depending on the intended use of the helmet and the configuration of the helmet and the connectors 25, the outer shell 2 may be able to rotate relative to the head mount 20 about different axes, such as an axis extending generally from the front to the back of the head of the wearer, an axis extending generally from side to side of the head of the wearer and an axis extending generally parallel to the spine of the wearer. Appropriate design of the helmet and the connectors 25 enables control of rotation of the outer shell 2 relative to the head mount 20 about the different axes in response to different impacts.

FIG. 7 shows a view of the inside of a helmet having an example of an arrangement as depicted in FIG. 6. In the example shown, the outer shell 2 is formed from a relatively hard material. It may be integrally formed as a single element, for example by injection moulding. The head mount 20 is formed from a combination of a head band 30 that is configured to partially surround a wearer's head and a pair of straps 31 that are connected to the head band 30. Each of the straps 31 are configured to extend across the top of the head of a wearer.

In an arrangement, as depicted in FIG. 7, the strap 31 each extend between an opposing pair of connectors 25 that connect the head mount 20 to the outer shell 2. In the arrangement depicted in FIG. 7, the helmet 1 has four connectors 25 between the head mount 20 and the outer shell 2, which is sufficient to provide a strong and stable connection between the head mount 20 and the outer shell 2. It should be appreciated that in other arrangements, a greater number of connectors 25, for example six or eight connectors 25, may be used.

In an arrangement in which the head mount 20 is connected to the outer shell 2 by six connectors 25, it will be understood that, if the head mount 20 includes straps 31 that extend across the top of the head of a wearer, the head mount 20 may include three straps 31. Similarly, an arrangement with eight connectors 25 may have four straps 31 and so on. In such an arrangement, the straps 31 may extend between opposing pairs of connectors 25. A greater number of connectors 25 and associated straps 31 may be provided but, in general, it may be desirable to minimise the number of connectors 25 in order to minimise the cost of manufacturing the helmet 1.

In an arrangement, where different straps 31 are in proximity to each other, for example, at the top of the wearer's head, the straps 31 may not be connected to each other, permitting some movement of one strap relative to another. In other arrangements, the straps may be connected to each other where they cross. In a further arrangement, the head mount may include one or more straps that extend from a connection point to the remainder of the helmet 1 to a point at which it is connected to other straps, for example, at a location corresponding to the top of the head of a wearer of the helmet.

In an arrangement, the straps that extend across the top of the head of a wearer may be stiffer, namely have a lower modulus of elasticity, than the connectors 25.

FIGS. 8 and 9 depict examples of connectors 25 that may be used in the arrangements depicted in FIGS. 6 and 7. In an arrangement, each of the connectors 25 may be integrally formed as a single element, namely not formed from separate components that require assembly in order to form the connector 25. Configuring the connector 25 such that it can be integrally formed as a single element may greatly reduce the cost of manufacturing the helmet compared to an arrangement in which each connector is formed from an assembly. A connector 25 such as that depicted in FIGS. 8 and 9 may, for example, be formed in a single step by injection moulding. However, it will be appreciated that one or more finishing steps may also be required in the manufacture of a connector 25.

The connector 25 may be formed from any material with a suitable modulus of elasticity. In an arrangement, the connector 25 may be formed from an elastomer. This may be a ThermoPlastic Elastomer (TPE) and may be Thermoplastic Polyurethane (TPU). Other polymers with plasticizers may also be used. In an arrangement the connector may be formed from polypropylene. It will be appreciated that the selection of the material from which the connector 25 is formed may, in conjunction with specifying the dimensions of the connector 25, be used to provide a desired performance of the connector 25 under an impact to a helmet 1. Other desirable characteristics for the material selected for use of the connectors 25 may be its durability and, in particular, its ability to withstand the environment in which the helmet 1 is expected to be used.

The material chosen to form the connector 25 may be selected not only to provide a desired deformation profile under applied loading, namely a desired stiffness, but may also be selected to be shock absorbing, namely a material that absorbs energy when deformed under loading and released. Such shock absorbing effects may limit the rebound of the outer shell 2 following an impact on the helmet 1.

The connectors 25 may be configured such that they can be detachably connected to at least one of the outer shell 2 and the head mount 20. Such an arrangement may facilitate replacement of components within a helmet. For example, it may be possible to replace the connectors 25 and/or head mount 20 and re-use the outer shell 2 of a helmet 1.

The connector 25 may alternatively or additionally be configured such that it can be connected to the outer shell 2 and/or the head mount 20 by a mechanical connection that does not require a separate fixing. Such a connection, rather than, for example, use of an adhesive or welding, may facilitate manufacture of the helmet 1 and/or maintenance activities such as those discussed above. Avoiding the use of a separate fixing may also facilitate manufacture and/or reduce cost. However, it should be appreciated that in some arrangements, a separate fixing, such as a rivet, screw or bolt, may be used.

As shown in FIG. 7, the connector 25 depicted in FIG. 8 is configured to be connected to the outer shell 2 using an example of an interference fit connection. In particular, a first connection point 41 of the connector 25 that is used to connect the connector 25 to the outer shell 2 is formed from a flange. The flange 41 is configured to be inserted into a slot 43 formed within the outer shell 2. In order for the flange 41 of the connector 25 to fit within the slot 43 of the outer shell 2, it must be compressed, resulting in sufficient friction to hold the flange 41 within the slot 43, thereby connecting the connector 25 to the outer shell 2.

The connector 25 depicted in FIGS. 8 and 9 has as a second connection point 42 for connection to the head mount 20. For example, a rotationally engaged connection may be used that provides a mechanical connection without a separate fixing. As shown, the second connection point 42 of the connector 25 is formed as a slot-shaped aperture 42. FIG. 10 provides a view that depicts the connection of the connector 25 to the head mount 20. The head mount 20 includes a protrusion 44 having a section that has a shape corresponding to that of the slot-shaped aperture 42. When the protrusion 44 is oriented to match the orientation of the slot-shaped aperture 42, it may be passed through the slot-shaped aperture 42. Thereafter, the connector 25 may be rotated relative to the head mount 20 such that the protrusion 44 is no longer aligned with the slot-shaped aperture 42. It therefore, as shown in FIG. 10, cannot pass back through the slot-shaped aperture 42, securing the connector 25 to the head mount 20. Such a connection may be, or may be known as, a bayonet connection, a keyhole connection or a cam lock connection.

It should be appreciated that alternative arrangements of a rotationally engaged connection than that depicted in FIG. 10 may be used. Likewise, it should be appreciated that the arrangement discussed above may be reversed, such that an interference fit is used to connect the connector 25 to the head mount and a rotationally engaged connection may be used to connect the connector 25 to the outer shell 2. Alternatively or additionally, one or both of the connections may be replaced with another form of connection, such as a snap-fit connection.

In addition to the connection points 41, 42 for connecting the connector 25 to the outer shell 2 and the head mount 20, one or more of the connectors 25 may include an additional connection point 45, for example as depicted in FIGS. 8 and 9. In an arrangement, an additional connection point 45 may be used to provide an anchor point for an additional strap, such as a chin strap.

In the arrangement depicted in FIGS. 8 and 9, the additional connection point 45, which may be used to provide an anchor point for an additional strap, is further from the first connection point 41 than the second connection point 42. It should be appreciated that this may be reversed such that the second connection point 42 is further away from the first connection point 41 than an additional connection point. In general, in arrangements connectors 25 may be provided that have plural additional connection points which each may be in any position relative to the first and second connection points 41, 42.

In the description below connectors other than that shown in FIGS. 8 and 9 are discussed without reference to the provision of additional connection points. It should be understood that, although not depicted in the Figures, such connectors may include one or more additional connection points.

In some arrangements, some of the connectors 25 of a helmet 1, used to connect the head mount 20 to the outer shell 2, may comprise an additional connection point, such as for a chin strap, while others do not. Alternatively, all of the connectors 25 may be provided with an additional connection point 45, even if some of the connectors 25 do not use the additional connection point 45. This may simplify manufacturing.

In order to provide a helmet 1, in which the outer shell 2 can rotate relative to the head mount 20 as a result of an impact on the helmet 1 but does not move undesirably relative to the head mount 20 under normal use, namely when not subjected to that impact, the design of the connectors 25 may be tuned so that it deforms in a specific manner under different loading patterns.

In an arrangement, the first connection point 41 of the connector 25, which is configured to be connected to the outer shell 2, may be configured such that the connection point 41 does not rotate relative to the outer shell 2 when connected.

The connector 25 shown in FIGS. 8 and 9 has flat edges 46 on the flange that forms the first connection point 41, which engage with edges of the slot 43 within the outer shell 2 to prevent rotation of the connection point 41 relative to the outer shell 2. This may prevent movement of the outer shell 2 relative to the head mount 20 during normal use of the helmet 1 namely when a wearer is wearing the helmet but is not subjected to an impact on the helmet 1.

The connector 25 may be configured such that, under increased loading such as caused by an impact to the helmet 1, the second connection point 42 can rotate relative to the outer shell 2 about the first connection point 41 as a result of deformation of the connector 25. For example, in the example connector of FIGS. 8 and 9, the flat edges 46 of the flange forming the first connection point 41 may deform under relatively high loads, permitting rotation of the flange within the socket 43 in which it is inserted. In an example arrangement such as that shown in FIG. 7, in which the outer shell 2 is connected to the head mount 20 by a plurality of connectors 25 provided around a head band 30, rotation of the second connection point 42 about the first connection point 41 in each of the connectors 25 may enable the outer shell 2 of the helmet to rotate relative to the head mount 20 about an axis generally parallel to the spine of the helmet wearer.

Alternatively or additionally, in an arrangement the socket 43 may be configured to deform under relatively high loads, permitting the flange to rotate relative to the socket. Alternatively or additionally, deformation of parts of the connector 25 between the first and second connection points 41, 42 may enable rotation of the second connection point 42 about the first connection point 41.

Alternatively or additionally, the connector 25 may be configured to have a beneficial response to tensile loading between the first and second connection points 41, 42.

For example, the connector 25 may be configured such that under tensile loading between the first and second connection points, the connector initially extends with a first modulus of elasticity up to a threshold extension and, subsequently, extends with a second modulus of elasticity beyond the threshold extension. The second modulus of elasticity may be higher than the first modulus of elasticity such that initially the connector may extend relatively easily but, beyond an initial extension the stiffness may increase. Such an arrangement may permit an initial movement of the outer shell 2 relative to the head mount 20 in response to an impact but prevent excessive movement. This may be arrangement such that, at least for an impact up to a level that the helmet 1 is designed to withstand, the head mount 20 does not come into contact with the outer shell 2, namely the air gap 21 is not entirely eliminated.

In another arrangement, the connector 25 may be configured such that under tensile loading between the first and second connection points, the modulus of elasticity of the connector up to a first threshold extension is higher than the modulus of elasticity beyond the first threshold extension. This may enable the provision of a helmet 1 that in normal use for a wearer of the helmet 1 feels stable, namely the outer shell 2 has limited movement relative to the head mount 20 in the absence of an impact, but enables movement of the outer shell 2 relative to the head mount 20 in response to an impact. Such a connector may further be configured such that beyond a second threshold extension the connector extends with a third modulus of elasticity that is higher than the second modulus of elasticity. Accordingly, in such a helmet, although the outer shell 2 may move relative to the head mount 20 in response to an impact, excessive movement may be prevented such that, at least for an impact up to a level that the helmet 1 is designed to withstand, the head mount 20 does not come into contact with the outer shell 2.

In an arrangement, the threshold extension beyond which the modulus of elasticity of the connector increases may be an increase of at least 10 mm in the separation of the first and second connection points 41, 42. Such an arrangement may enable a helmet to be configured such that, under an impact, the outer shell may rotate relative to the head mount 20 by a sufficient amount, such as a local relative movement of at least 10 mm, that the helmet can manage the rotational energy created by the impact and reduce the likelihood of significant injury.

In the arrangement of connector 25 depicted in FIG. 9, the connection points 41, 42 are connected by a pair of curved limbs 48. Under tensile loading between the connection points 41, 42, the limbs 48 are deformed to become straight. This straightening of the limbs 48 provides a first modulus of elasticity for the connector 25 under tensile loading. A threshold extension is then reached, corresponding to the extension necessary for the limbs 48 to become straight. FIG. 11 depicts the connector 25 under further loading. As shown, in order to stretch the connector 25 beyond the threshold extension. The limbs 48 are stretched. This requires greater force for each incremental extension, resulting in a second, higher, modulus of elasticity of the connector 25.

It should be appreciated that other configurations of the connector 25 may achieve a desirable deformation profile under loading and variations of the arrangement depicted in FIGS. 9 and 10 may be used. For example, the limbs 48 need not be curved as shown. In general, limbs of any non-straight initial configuration may be used in order to provide an initial modulus of elasticity as the limbs are straightened and a second modulus of elasticity as the limbs are subsequently stretched.

Figure 12:
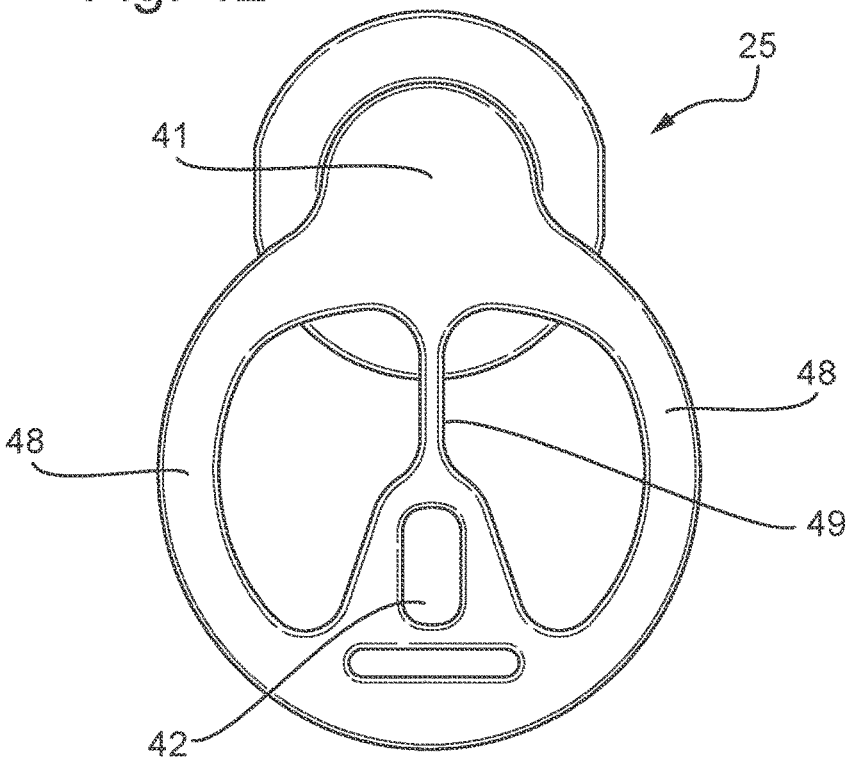

In an arrangement, as shown in FIG. 12, a connector 25 may include a limb 49 that is straight without extension of the separation between the first and second connection points 41, 42, in order to increase the initial modulus of elasticity.

Figure 13:
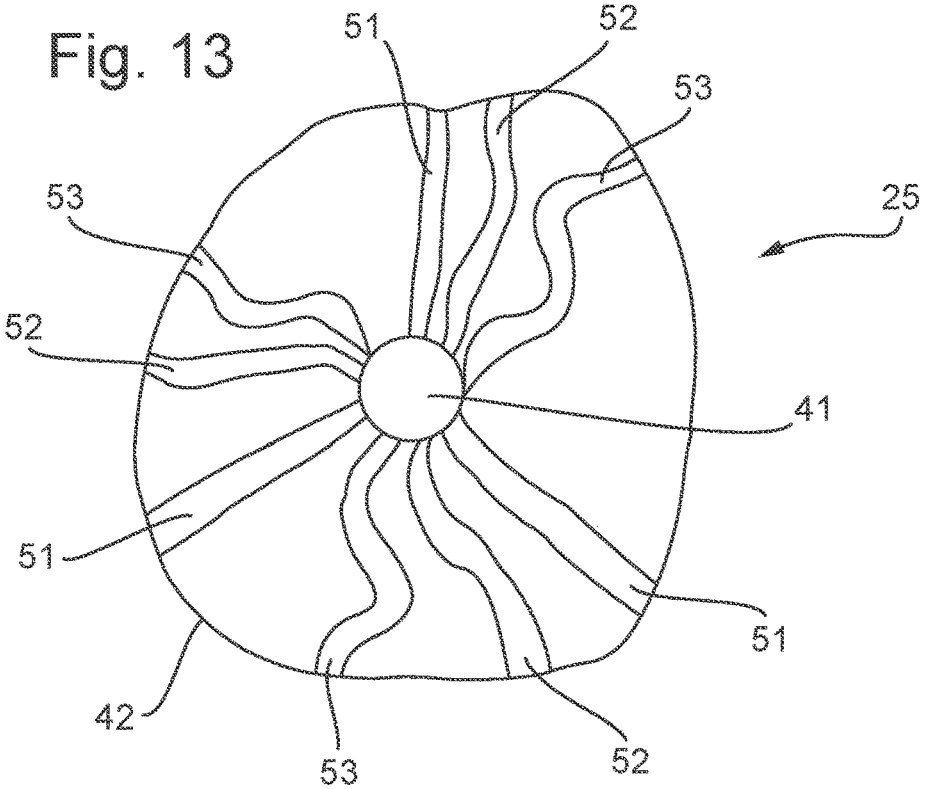

Alternatively or additionally, any number of limbs 48 may be used. Where plural limbs 48 are used, the limbs 48 may be configured to become straight at different extensions of the separation of the first and second connection points 41, 42, resulting in additional transitions of the modulus of elasticity of the connector 25. Alternatively or additionally, where plural limbs 48 are used, different limbs may be formed from different thicknesses and/or may be formed from difference materials in order to affect the overall stiffness of the connector 25 as each of the limbs 48 become straight. An arrangement with plural transitions is schematically depicted in FIG. 13, in which connection points 41, 42 are connected by plural sets of limbs 51, 52, 53 that under tension become straight, resulting in an increase in the overall modulus of elasticity of the connector, at different extensions.

Figure 14:
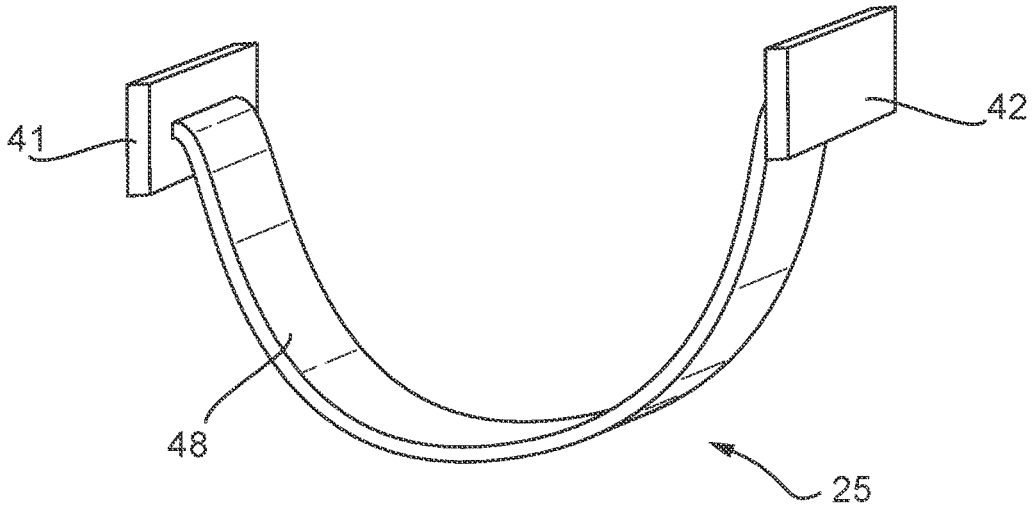

FIG. 14 depicts a further variation of a connector 25 that has a single limb 48. In an undeformed condition, the limb 48 is not straight. Accordingly, under an initial tensile load between the connection points 41, 42, the modulus of elasticity is relatively low. At a threshold extension, the single limb 48 becomes straight, resulting in an increase in the modulus of elasticity beyond the threshold extensions. Such a single-limb configuration may be relatively easy to manufacture.

Figure 15:
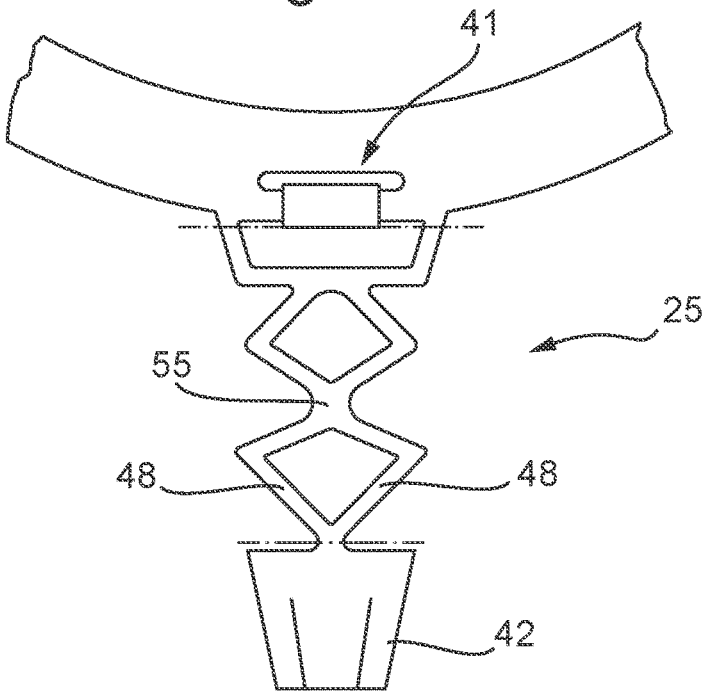

More complex geometries may be used than one or more limbs extending between the first and second connection points 41, 42. Such arrangements may enable the provision of further enhancements in the response to tensile loading between the first and second connection points 41, 42. For example, as schematically depicted in FIG. 15, in an arrangement having plural non-straight limbs 48 extending between first and second connection points 41, 42, at one or more locations 55, the limbs 48 may be joined.

Figure 16:
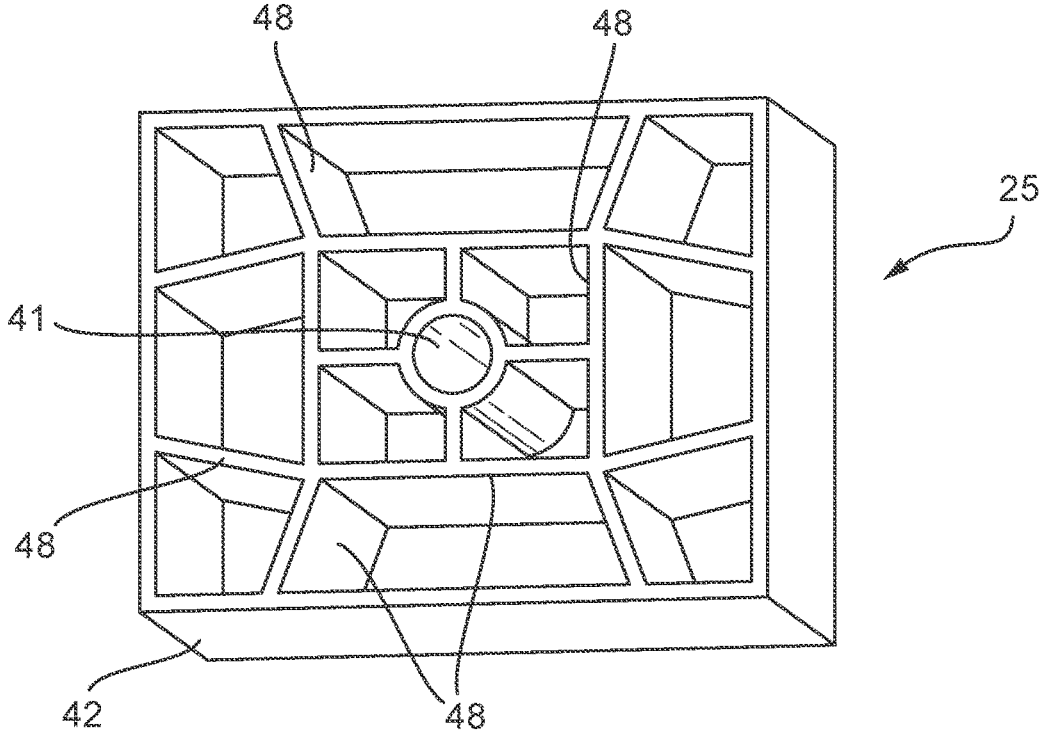

FIG. 16 depicts a further example of such an arrangement, in which a latticework of plural limbs 48 combine to extend between the first and second connection points 41, 42. Under tensile loading of such a structure, multiple threshold extensions may be provided at which different limbs 48 switch from deforming in a first mode, such as bending or straightening, to a second mode, such as stretching of the limb 48 itself.

In some arrangements, for example those depicted in FIGS. 13 and 16, the connector 25 may be configured such that the second connection point 42 is the exterior surface of the connector 25 and may substantially surround it. Such connectors 25 may be configured to provide a desirable response to tensile loading between the first and second connection points 41, 42, namely having changes of modulus of elasticity at one or more threshold extensions as discussed above, for tensile loading in plural directions.

Figure 17:
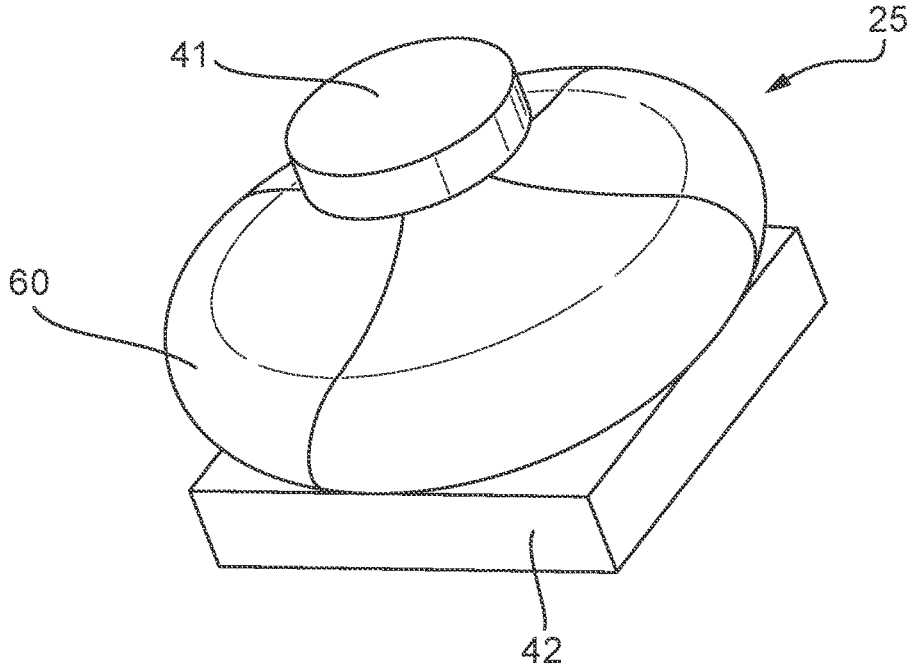
Figure 18:
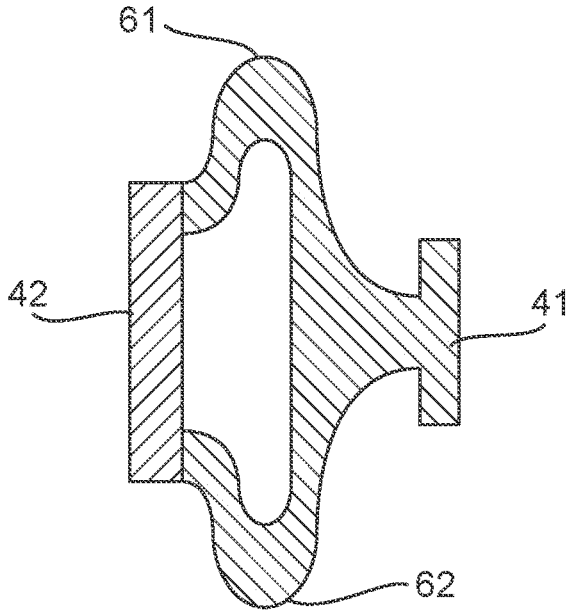

FIGS. 17 and 18 depict, in perspective view and cross-section, respectively, a further example of a connector providing a beneficial response to tensile loading in multiple directions. As shown, in this arrangement, the connector 25 is formed from a surface 60 that extends between the first and second connection points 41, 42. In effect, the surface 60 can be considered to be formed from a plurality of sections 61, 62 that are joined together to form a single integrally formed element, namely the surface 60. The sections 61, 62 may each function in a similar manner to the limbs of the previous arrangements.

Under a condition in which the connector 25 is installed within the helmet 1, all of the sections 61, 62 of the surface 60 are not straight. Accordingly, up to a first threshold extension, the first connection point 41 may move relative to the second connection point 42 merely by straightening a section of the surface 60. At the threshold extension, one side of the surface 60, for example the section 62 depicted in FIG. 18 if the first connection point 41 were moved upward relative to the second connection point 42, becomes straight, increasing the modulus of elasticity for further extension because it would become necessary to stretch that section 62 of the surface 60.

Figure 19:
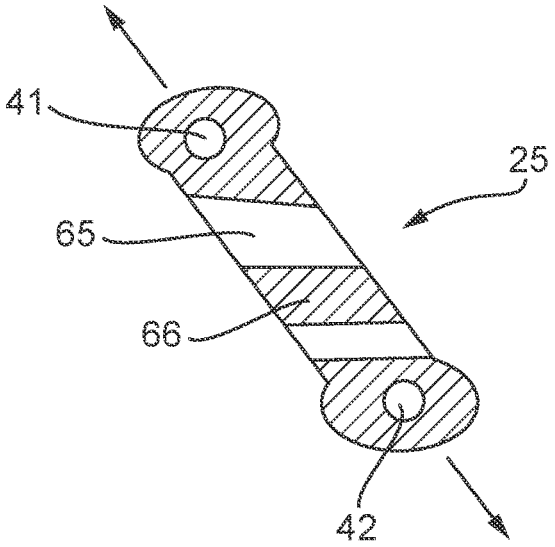

FIG. 19 depicts a further arrangement of a connector 25 that may be used to provide a desired response to tensile loading between the first and second connection points 41, 42. As shown, the connector 25 depicted in FIG. 19 includes a first element 65 that extends in a straight line between the first and second connection points 41, 42 and a second element 66 that is loosely wound around the first element 65 and extends between first and second connection points 41, 42. Under initial tensile loading, the resistance to extension is primarily provided by extension of the first element 65, providing a first modulus of elasticity. During this phase, the second element 66, wound around the first element 65 can extend relatively easily. However, as the extension increases, the second element 66 grips the first element 65 increasingly tightly. Further extension between the first and second connection points 41, 42, therefore becomes only possible either through the second element 66 compressing the first element 65 transverse to the extension direction or by the extension of the second element 66 along its length. This results in an increase in the stiffness of the connection 25.

Figure 20:
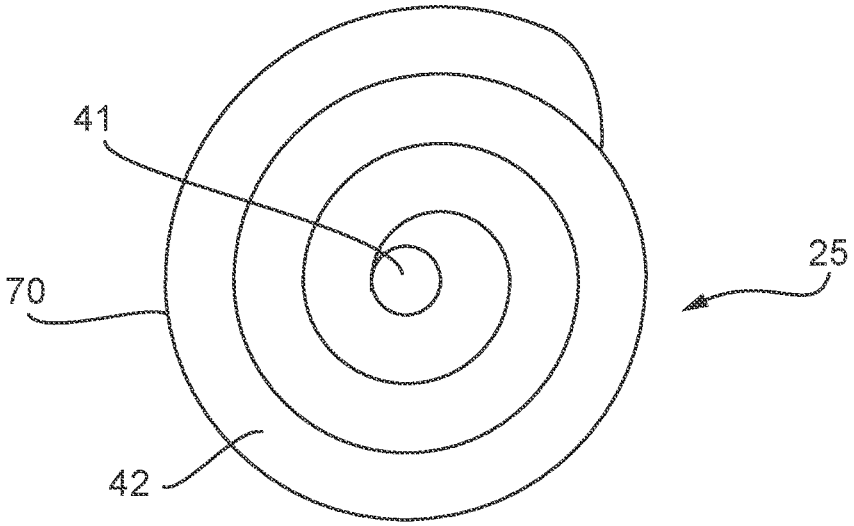

FIG. 20 depicts a further arrangement that may be used to provide a connector 25 with a desirable response to tensile loading between first and second connection points 41, 42. As shown, the connector may be based upon a coil spring 70. The initial resistance to extension between the first and second connection points 41, 42 in a direction perpendicular to the axis of the coil spring 70 may be provided by the spring resistance and by friction between the layers of the spring. Once the movement of the first connection point 41 relative to the second connection point 42 in a direction perpendicular to the axis of the coil spring 70 exceeds a threshold, the layers of the coil spring 70 on one side of the coil spring 70 press against each other with no gaps between them. Beyond that point, the stiffness of the connector 25 increases.

Figure 21:
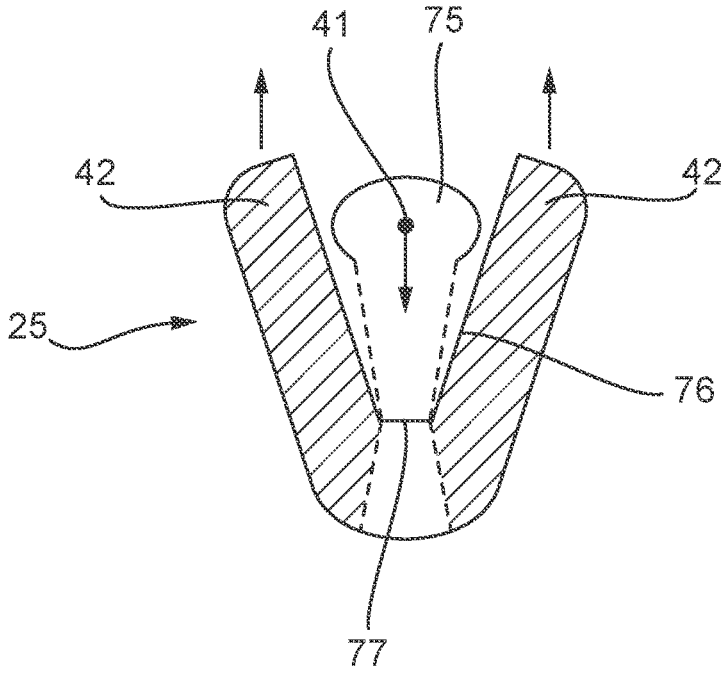

FIG. 21 schematically depicts a further example of a connector 25 configured to provide a desired response to tensile loading between first and second connection points 41, 42. In this arrangement, the connector 25 includes an insert 75 that is connected to the first connection point 41 and a slot 76 formed from a resilient material that is connected to the second connection point 42. The insert 75 is configured to be inserted into the slot 76. In an arrangement as shown in FIG. 21, the slot 76 may be configured to narrow away from its opening such that, as the insert 75 is inserted into the slot 76, the resilient material forming the slot 76 is compressed to accommodate the insert 75. In turn, this results in the reaction force exerted on the insert 75 by the slot 76 increasing, correspondingly increasing friction. Beyond a given extension of the first connection point 41 relative to the second connection point 42, the insert 75 may reach the base 77 of the slot 76. Beyond this threshold, the first connection point 41 may only extend further relative to the second connection point 42 by extension of the sidewalls of the material in which the slot 76 is formed and/or by compression of the material at the base 77 of the slot 76, increasing the stiffness of the connection. It should be appreciated that the same effect may be provided if alternatively or additionally the insert 75 comprises a resilient material.

Figure 22:
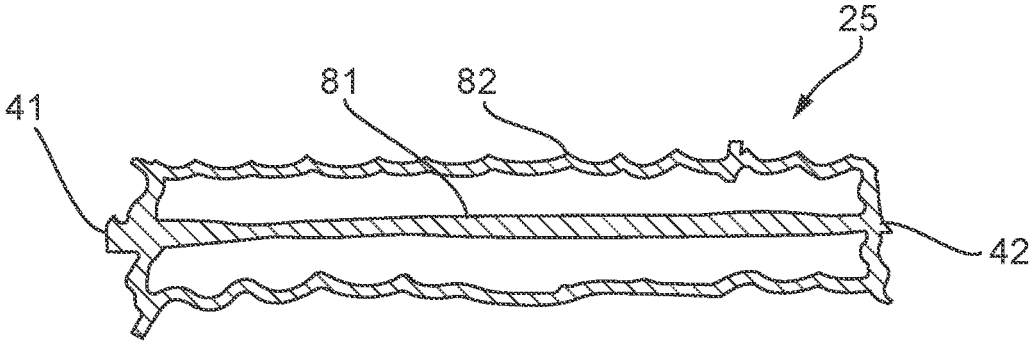

FIG. 22 schematically depicts a further possible arrangement of a connector 25 for connecting first and second connection points 41, 42. In the arrangement shown, the connector includes a first element 81 that, under tensile loading between the first and second connection points 41, 42 may extend by stretching of the first element 81. The connector 25 further includes a section of webbing 82 which may, for example, surround the first element 81. The webbing 82 may be formed from, for example, a woven material that initially stretches relatively easily as a result of fibres within the webbing 82 moving relative to each other. Up to this point, the modulus of elasticity of the connector 25 is determined primarily by the stiffness of the first element 81. Beyond the threshold extension, the webbing 82 may only extend further either by stretching of the individual fibres within the webbing 82 and/or by rupturing of fibres within the webbing 82, resulting in the stiffness of the connector 25 increasing beyond the threshold extension.

Figure 23:
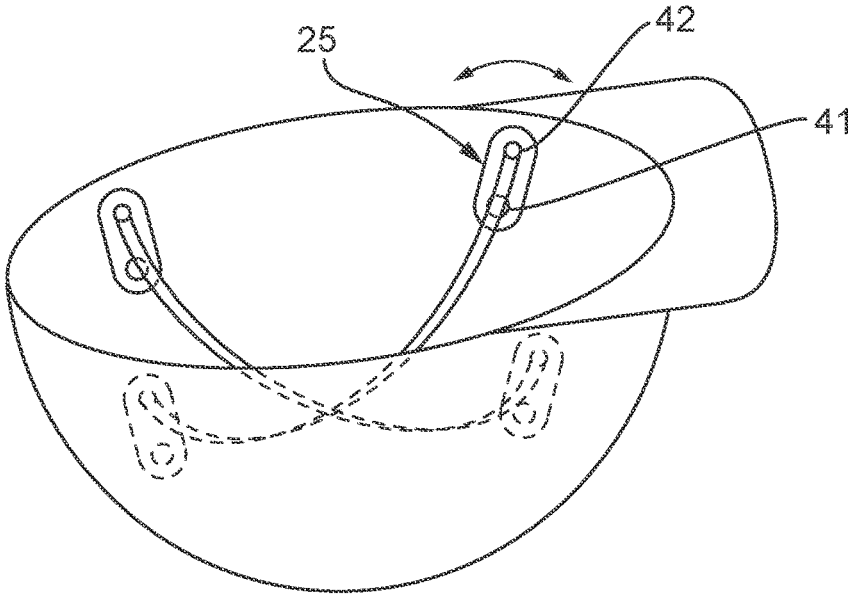

FIG. 23 depicts a further example of a connector 25 providing a desired response to tensile loading between the first and second connection points 41, 42. The connector 25 is installed and is configured such that the connection points are positioned in an inverted position. Accordingly, in an initial position, tensile loading between the first and second connection points 41, 42 exerts a force on the connection points towards each other. Accordingly, in the arrangement depicted in FIG. 23, for example, the tensile loading on the connector 25 results in the second connection point 42 being urged in a direction towards the first connection point 41, in a downwards direction of the image depicted in FIG. 22. The connector 25 is constrained, however, by its connection at the first connection point 41 to the outer shell 2. Accordingly, for the second connection point 42 to move downwards, the connector 25 is compelled to rotate about the first connection point 41. This may occur, for example by deformation of the first connection point 41, providing an initial modulus of elasticity for the extension, namely the movement of the second connection point 42.

Once the connector 25 rotates about the first connection point 41 by 180 degrees the second connection point 42 is no longer able to extend relative to the first connection point 41 merely by rotation of the connector 25. Beyond this threshold, further extension of the second connection point 42 relative to the first connection point 41 requires deformation of the connector 25, for example stretching of the connector 25, increasing the stiffness of the connector 25 beyond this threshold.

It should be appreciated that, in a variation of such a configuration, a physical stop may be provided that prevents rotation of the connector 25 about the first connection point 41 at an earlier point. This may reduce the threshold extension before the stiffness of the connector 25 increases. Alternatively or additionally, the connector 25 may be configured such that the unloaded position of the connector is pre-rotated compared to the configuration depicted in FIG. 22, namely such that the extent of rotation of the connector 25 about the first connection point to reach a point at which further extension of the second connection point relative to the first connection point 41 cannot be achieved by rotation of the connector 25 is less than 180 degrees.

The invention claimed is:

1. A helmet, comprising:

an outer shell;

a head mount, configured to conform to a head of a wearer; and a plurality of connectors formed from an elastomer, each of the plurality of connectors provided between the outer shell and the head mount and each of the plurality of connectors connected to the outer shell and head mount;

wherein the connectors are configured to suspend the head mount within the outer shell such that, in use, an air gap is provided between head mount and the outer shell;

the connectors each have a first connection point connected to the outer shell and a second connection point connected to the head mount;

at least one connector of the plurality of connectors comprises a pair of limbs that are curved when there is no load on the at least one connector, and the limbs are configured such that, under tensile loading between the first and the second connection points below a threshold, the limbs straighten, and above the threshold, the limbs elongate by stretching of the elastomer;

when there is no load on the at least one connector, each limb of the pair of limbs is curved such that each limb of the pair of limbs has a convex curve and a concave curve on opposing sides of the limb, and the concave curve of a first of the pair of limbs faces the concave curve of the second of the pair of limbs forming opposed concave curves of the pair of limbs;

and a part of the at least one connector comprising the second connection point is located in an interior of a space defined by the opposed concave curves of the pair of limbs.

2. The helmet according to claim 1, wherein a ratio of a force exerted on the limbs to an extension of the limbs induced by the force is higher above the threshold than below the threshold.

3. The helmet according to claim 1, wherein at least one ratio of a force exerted on the limbs to an extension of the limbs induced by the force is lower than at least one of a ratio of a force exerted on the outer shell to an extension of the outer shell induced by the force and a ratio of a force exerted on the head mount to an extension of the head mount induced by the force.

4. The helmet according to claim 1, wherein the connectors are each integrally formed as a single element.

5. The helmet according to claim 1, wherein the connectors are detachably connected to at least one of the outer shell and the head mount.

6. The helmet according to claim 1, wherein the connectors are connected to at least one of the outer shell and the head mount by a mechanical connection that does not require a separate fixing, separate to the outer shell, the connectors and the head mount.

7. The helmet according to claim 1, wherein the connectors are connected to at least one of the outer shell and the head mount by at least one of a snap-fit connection, an interference fit connection and a rotationally engaged connection.

8. The helmet according to claim 1, wherein the plurality of connectors consists of 4 or 6 connectors.

9. The helmet according to claim 1, wherein at least two of the connectors are configured to provide an anchor point for a chin strap.

10. The helmet according to claim 1, wherein the first connection point is formed as a flange configured to be inserted into a slot formed within the outer shell so as to prevent rotation relative to the outer shell.

11. The helmet according to claim 10, wherein the second connection point of the at least one connector can rotate relative to the outer shell about the first connection point of the at least one connector by deformation of the at least one connector.

12. The helmet according to claim 10, wherein the flange is configured as a disk having flat edges on opposing sides of the disk, the flat edges configured to engage with corresponding edges of the slot formed within the outer shell so as to prevent rotation of the flange relative to the outer shell.

13. The helmet according to claim 10, wherein the flange is compressed in order that the flange fits within the slot formed within the outer shell, thereby connecting the connector to the outer shell by an interference fit connection.

14. The helmet according to claim 1, wherein the threshold extension is an increase of at least 10 mm in separation of the first and the second connection points.

15. The helmet according to claim 1 wherein the head mount comprises a plurality of straps that are configured to extend across a top of the head of the wearer and extend between an opposing pair of connectors of the plurality of connectors.

16. The helmet according to claim 15 wherein a ratio of a force exerted on the straps forming the head mount to an extension of the straps induced by the force is higher than a ratio of a force exerted on the limbs to the extension of the limbs induced by the force.

17. The helmet according to claim 1, wherein, in an absence of an impact on the helmet, a separation between the outer shell and the head mount at a location configured to correspond to a top of the head of the wearer provided by the air gap is at least 10 mm.

18. The helmet according to claim 1, wherein the second connection point is formed as a slot-shaped aperture configured to receive a protrusion provided on the head mount, the slot-shaped aperture and protrusion having corresponding shapes such that, when the protrusion is oriented to match an orientation of the slot-shaped aperture, the protrusion may be passed through the slot-shaped aperture, and the connector may be rotated relative to the head mount such that the protrusion is no longer aligned with the slot-shaped aperture and cannot pass back through the slot-shaped aperture, thereby securing the connector to the head mount.

* * * * *